United States Patent [19]

Merchant

[11] 4,291,291

[45] Sep. 22, 1981

[54] CIRCUIT BREAKER PROVIDED WITH COLLAPSIBLE TELESCOPING LINKAGE

[75] Inventor: Donald K. Merchant, Cambridge, Md.

[73] Assignee: North American Philips Controls Corp., Cambridge, Md.

[21] Appl. No.: 76,668

[22] Filed: Sep. 18, 1979

[51] Int. Cl.[3] ..... H01H 5/00

[52] U.S. Cl. ..... 335/191; 335/188; 335/21; 335/167

[58] Field of Search ..... 335/191, 190, 189, 188, 335/187, 21, 38, 167

[56] References Cited

U.S. PATENT DOCUMENTS 3,806,848 4/1974 Harper et al. ..... 335/191

4,139,830 2/1979 Streich et al. ..... 335/191

*Primary Examiner*—Harold Broome

*Attorney, Agent, or Firm*—LeBlanc, Nolan, Shur & Nies

[57] ABSTRACT

A circuit breaker incorporates a collapsible telescoping linkage installed between its control handle and electrical contacts. The collapsible telescoping linkage is normally locked in an extended position to open and close the contacts as the control handle is moved between its off and on positions. The circuit breaker includes an electromagnetically operated armature operable in response to an overload condition to unlock the collapsible telescoping linkage to allow the linkage to collapse and instantaneously break the contacts. Thereafter, when the control handle moves to its off position, the linkage is locked in its extended position so that upon subsequent movement of the control handle to its on position the circuit breaker is automatically reset.

17 Claims, 6 Drawing Figures

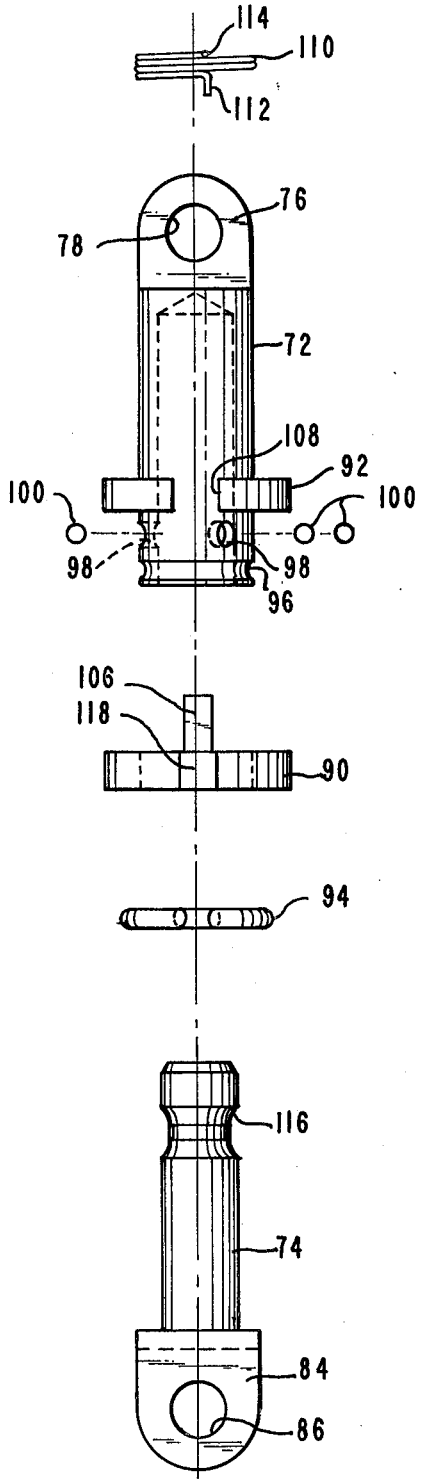
FIG. 4
FIG. 5
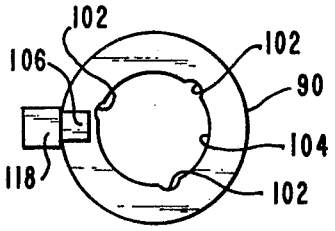
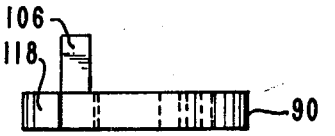
FIG. 6

CIRCUIT BREAKER PROVIDED WITH COLLAPSIBLE TELESCOPING LINKAGE

The present invention relates to a circuit breaker for protecting an electrical circuit against overload conditions and, more particularly, to a circuit breaker incorporating a collapsible telescoping linkage which is locked in an extended position in normal on-off operating and which is adapted to collapse when unlocked to swiftly separate its electrical contacts under an overload condition.

Electromechanical circuit breakers generally employ switch mechanisms which are bulky and complicated in structure and difficult and costly to manufacture. Typically, the circuit breaker switch mechanisms of the prior art include numerous small parts which require critical dimensional tolerances and extremely sensitive assembly and adjustment procedures. When tripped by an overload condition, these circuit breakers tend to react slowly with a tendency to produce arcing as the electrical contacts are disengaged.

One type of circuit breaker known in the prior art employs a scissor-like linkage provided with a cam and follower locking mechanism which normally maintains its electrical contacts closed and causes the contacts to disengage with an arcuate movement when an overload condition exists. This design has critical dimensional tolerances and requires extremely sensitive set-up procedures which make it difficult and expensive to manufacture, assemble and adjust.

Other examples of complicated circuit breaker mechanisms are disclosed in Atwood, U.S. Pat. No. 2,328,942; Frink et al, U.S. Pat. No. 3,198,906; and Price, U.S. Pat. No. 3,309,636. These patents disclose various circuit breaker linkage mechanisms incorporating rigid, non-collapsible connecting rods in contrast to the collapsible telescoping linkage of this invention.

The present invention contemplates an improved switch control mechanism for a circuit breaker incorporating a collapsible telescoping linkage installed between a control handle and a set of electrical contact elements. The collapsible telescoping linkage is normally first locked in an extended position and is adapted to collapse when unlocked to rapidly disengage the electrical contact elements with a generally straight movement upon occurrence of an overload condition in the electrical circuit protected by the circuit breaker. In its extended position, the telescoping linkage provides a rigid connection which ensures positive action of the electrical contact elements in response to movement of the control handle between its on and off positions. However, the telescoping linkage is readily collapsible when an overload condition is detected to rapidly disengage the electrical contact elements with minimal possibility of arching therebetween. The unique collapsible telescoping linkage provides a circuit breaker switch which is uncomplicated and compact in structure in comparison with the cumbersome switching devices employed in prior art circuit breakers.

A circuit breaker embodying the invention comprises a control handle selectively movable between the on and off positions, contact means including a pair of relatively movable contact elements for making and breaking an electrical circuit protected by the circuit breaker, collapsible coupling means connected between the control handle and the electrical contact elements for opening and closing the contact elements upon movement of the control handle between its off and on positions, respectively, which is adapted to lock in an extended position to hold the contact elements engaged with the control handle moved to its on position and to collapse when unloced to allow the contact elements to disengage, and actuator means operable in response to an overload condition in the electrical circuit for unlocking the coupling means to disengage the contact elements and break the electrical circuit. Preferably, to allow the circuit breaker to be conveniently reset, the coupling means is locked in its extended position by movement of the control handle to its off position with the contact elements disengaged.

In a preferred embodiment of the circuit breaker, the coupling means comprises a pair of relatively slidable telescoping members provided with a locking device operable with the telescoping members extended to prevent relative sliding movement therebetween and adapted to be unlocked to permit telescoping members to collapse together. Preferably, one of the telescoping members comprises a tubular barrel having an open end, and the other telescoping member comprises a slide rod slidably received within the open end of the barrel. The locking device is embodied as a plurality of ball bearings located within a set of angularly spaced holes formed in the tubular barrel adjacent to its open end, an annular groove formed in the slide rod for alignment with the holes with the slide rod extended from the barrel, and a collar rotatably disposed on the tubular barrel over the holes and adapted to control the positions of the ball bearings therein. The collar is rotatable between a lock position wherein the ball bearings are held in the groove of the slide rod to preclude relative sliding movement of the barrel and slide rod and an unlock position wherein the ball bearings are able to move out of the groove to permit the rod to slide relative to the barrel.

The preferred embodiment of the circuit breaker includes an electromagnetic device for sensing an overload condition in the electrical circuit and a control arm actuated by the electromagnet or other suitable means for rotating the collar to its unlock position when an overload condition is sensed. In addition, the circuit breaker includes bias means for collapsing the telescoping barrel and slide rod together when the collar is moved to its unlock position to disengage the electrical contact elements. Preferably, this bias means is embodied as a spring which normally urges the electrical contact elements apart.

Accordingly, it is an object of the present invention to provide an improved circuit breaker control mechanism which is uncomplicated and compact in structure in comparison with prior art devices.

Another object of the invention is to provide a circuit breaker switch incorporating a collapsible telescoping linkage which is locked in an extended position for positive on-off operations and which is adapted to collapse in response to an overload condition to rapidly disengage its electrical contact elements to break the electrical circuit protected by the circuit breaker.

It is also an object of the invention to provide an improved circuit breaker control mechanism which allows for a relatively quick contact separation when an overload condition is detected and reduces arcing between its electrical contacts in comparison with prior art devices.

A further object of the invention is to provide a circuit breaker control mechanism which eliminates the critical dimensional tolerances required in prior art devices, requires little or no adjustment in operation, and is less costly to manufacture.

These and other objects will be readily apparent with reference to the drawings and following description wherein:

FIG. 4 is an exploded view of the components of the collapsible telescoping linkage;

FIG. 5 is a plan view of a rotatable collar employed in the collapsible telescoping linkage; and FIG. 6 is a side view of the rotatable collar.

Figure 1:
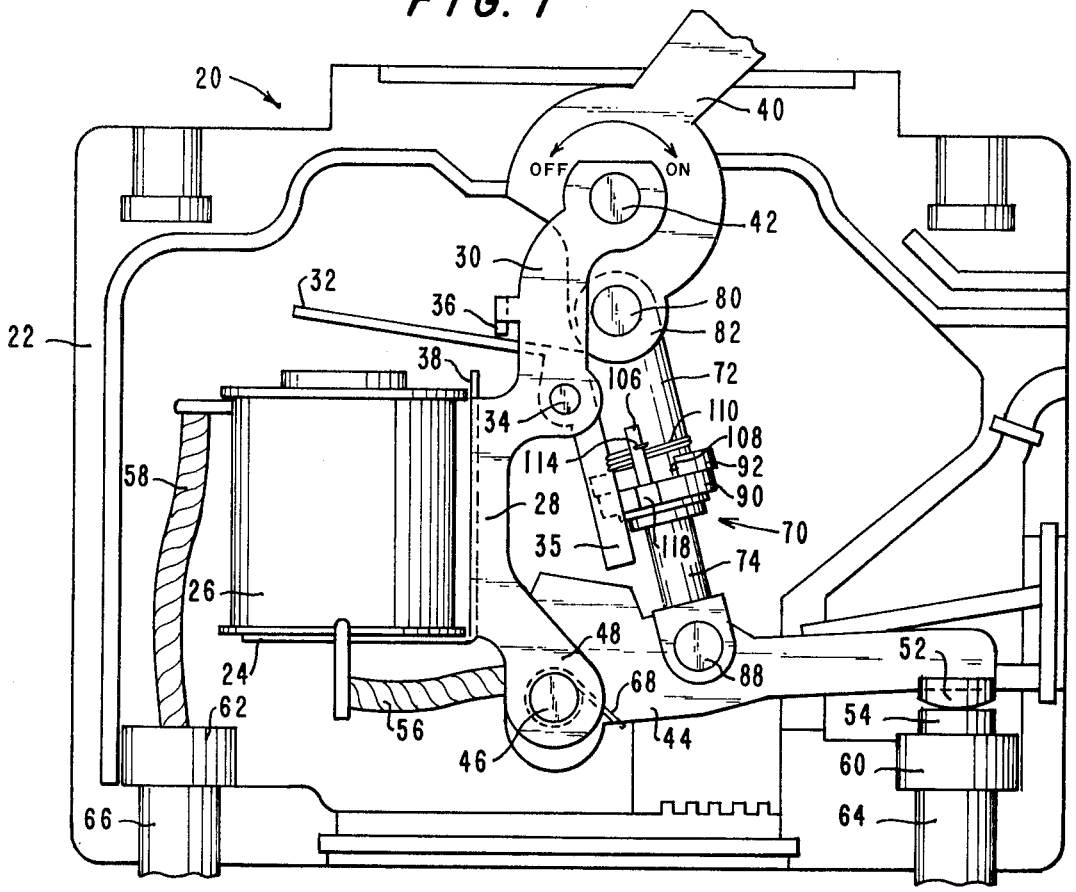
FIG. 1 is a side elevation, partially in section, illustrating a circuit breaker including a switch control mechanism provided with a collapsible telescoping linkage embodying the principles of this invention.

Referring to FIG. 1, a circuit breaker, generally 20, includes a housing 22 of insulating material, e.g., molded plastic, wherein an L-shaped support frame 24 which supports an electromagnetic coil 26 is mounted. The support frame includes a pair of space, vertical side flanges 28 (one shown) each including an upper arm 30 on which an armature 32 actuated by electromagnetic coil 26 is pivotally mounted via a transverse pivot pin 34. Armature 32, which is normally biased upward from electromagnetic coil 26 by a coil spring (not shown), includes a downwardly extending actuator arm 35. An upper stop member 36 extends transversely between arms 30 to limit the upward movement of armature 32, and a lower stop member 38 is provided on the support frame to limit its downward movement.

The circuit breaker switch mechanism includes a control handle 40, preferably made of plastic material, pivotally mounted at the upper ends of arms 30 via a transverse pivot pin 42 for movement between on and off positions. The switch mechanism also includes a movable contact bar 44 pivotally mounted by a transverse pivot pin 46 on a pair of lower legs 48 formed on side flanges 28. Contact bar 44 includes an elongated slot 50 (FIGS. 2 and 3) in which pivot pin 46 is slidably received. The contact bar also includes an electrical contact element 52 which is movable into and out of engagement with a stationary contact element 54 mounted on the circuit breaker housing. A conductor 56 electrically connects contact bar 44 to one end of electromagnetic coil 26, while its other end is connected to a wire 58. Contact element 54 and wire 58 are electrically connected to terminals 60 and 62, respectively, which in turn are connected to conductors 64 and 66 which form part of an electrical circuit protected by the circuit breaker. A torsion spring 68 mounted on pivot pin 46 provides a bias to normally urge contact bar 44 and movable contact element 52 upward away from stationary contact element 54.

Figure 2:
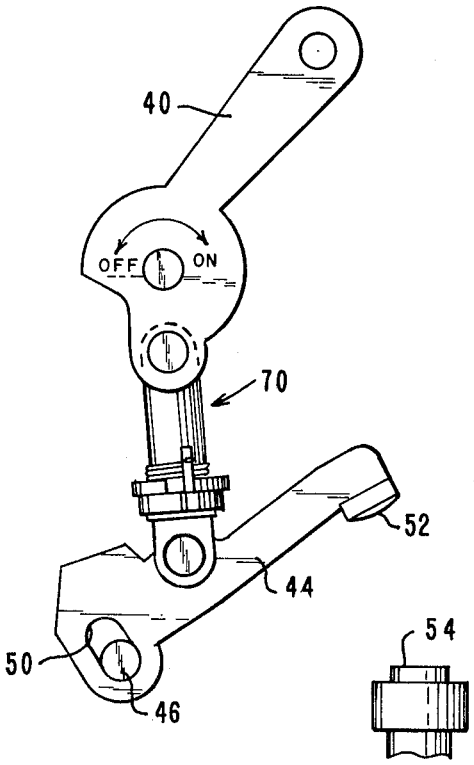
FIG. 2 illustrates the circuit breaker switch mechanism actuated in response to an overload condition to collapse the telescoping linkage and disengage its electrical contacts.
Figure 3:
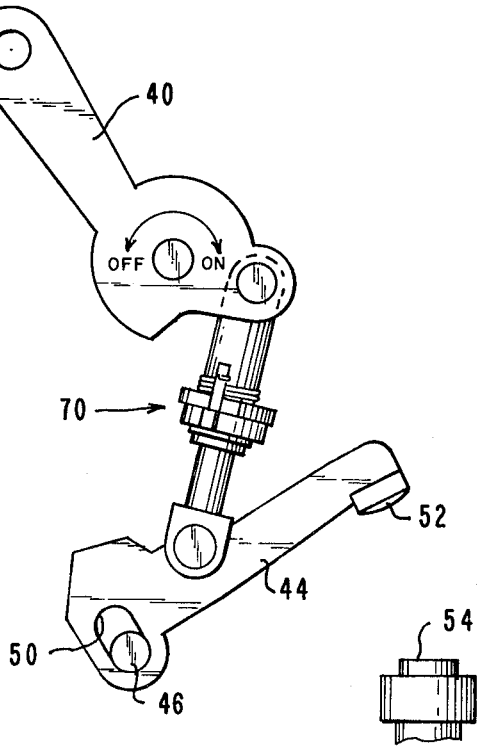
FIG. 3 illustrates the circuit breaker switch mechanism with its control handle moved to the off position to reset the collapsible telescoping linkage in its extended position.

In accordance with the invention, a collapsible telescoping linkage, generally 70, is connected between control handle 40 and contact bar 44 which is adapted to lock in an extended position, shown in FIGS. 1 and 3, to enable electrical contact elements 52 and 54 to open and close upon movement of the handle between its off and on positions and which is adapted to collapse, as shown in FIG. 2, when unlocked to allow the contact elements to open in response to an overload condition in the electrical circuit.

A preferred embodiment of the collapsible telescoping linkage includes a tubular, barrel-like member 72 having a lower open end in which a slide rod 74 is slidably received. As shown in FIG. 4, barrel 72 includes a flattened extension 76 at its upper end provided with a hole 78 for pivotal connection via a pivot pin 80 to an offset lobe 82 formed on handle 40. Slide rod 74 may include a pair of spaced, parallel lugs 84 (one shown) at its lower end each provided with a hole 86 for pivotal connection via a pivot pin 88 to contact bar 44. In an alternate arrangement (not shown), contact bar 44 may have a U-shaped region to which rod 74 having a single lug 84 may be connected by a pivot pin 88.

A locking device including a collar 90 rotatably disposed on the lower end of tubular barrel 72 is provided to normally lock the collapsible telescoping linkage in its extended position and to unlock the linkage when an overload condition exists to enable the linkage to collapse and break the electrical circuit protected by the circuit breaker. An annular flange 92 is provided on barrel 72 adjacent to its lower end which defines the position of collar 90. A retainer ring 94 is snap fitted into a peripheral groove 96 at the lower end of barrel 72 to hold collar 90 in place. The collar is rotatably disposed over a set of angularly spaced holes 98 which extend through the sides of barrel 72 adjacent to its lower end. Preferably, three equally spaced peripheral holes 98 are provided. A corresponding set of ball bearings 100 is located within holes 98.

Collar 90 is adapted to control the positions of ball bearings 100 in holes 98, i.e., to move the ball bearings radially inward and outward relative to barrel 72. As shown in FIG. 5, collar 90 includes a set of notches 102 formed on its inner annular surface 104 which correspond in number and placement to holes 98 formed in barrel 72. Collar 90 is rotatable between a lock position wherein notches 102 are out of alignment with holes 98 and an unlock position in which the notches and holes are aligned. Preferably, the extent of rotation of collar 90 relative to barrel 72 is determined by a stop pin 106 provided on the collar which extends upwardly through a gap 108 defined by a cut-away portion of flange 92. A coil spring 110 is mounted on barrel 72 above flange 92 with one of its ends 112 anchored in a suitable hole (not shown) provided in the flange and its other end 114 wrapped around stop pin 106 which is preferably notched to prevent the end of the spring from slipping off. Coil spring 110 serves to normally urge stop pin 106 against one side of gap 108 in flange 92 to maintain collar 90 in its lock position with notches 102 out of alignment with holes 98.

Slide rod 74 includes an annular groove 116 formed adjacent to its upper end which is located in alignment with holes 98 in barrel 72 with the slide rod extended from the barrel. With collar 90 in its lock position, ball bearings 100 are urged into groove 116 to lock slide rod 74 in its extended position relative to barrel 72. Collar 90 includes an outwardly extending finger 118 which is engaged by actuator arm 35 when an overload condition occurs to rotate the collar to its unlocked position wherein notches 102 are in alignment with holes 98. As a result, ball bearings 100 are able to move radially outward to allow slide rod 74 to retract into barrel 72 under the action of spring 68 to disengage contacts 52 and 54.

Referring to FIG. 4, the collapsible telescoping linkage is assembled by initially sliding retainer ring 94 and collar 90 onto slide rod 74. The slide rod is inserted into the open end of tubular barrel 72 and its groove 116 is aligned with holes 98. Ball bearings 100 are dropped into holes 98 and collar 90 is slid into place adjacent to annular flange 92 to cover the ball bearings and holes in the tubular barrel with stop pin 106 extending upwardly through gap 108 in the annular flange. Next, retainer ring 94 is snap fitted into peripheral groove 96 to hold rotatable collar 90 in place. Coil spring 110 is slid down and over the top end of barrel 72 with its end 112 inserted into the corresponding hole (not shown) in flange 92 and its other end 114 wrapped around stop pin 106.

In the operation of the circuit breaker, slide rod 74 is normally locked in its extended position relative to barrel 72 to permit simple on-off operations by movement of control handle 40 between its on and off positions (FIGS. 1 and 3). With control handle 40 in its on position (FIG. 1) linkage 70 holds contact bar 44 down against the bias of spring 68 to maintain contact elements 52 and 54 engaged. When an overload condition occurs in the electrical circuit protected by the circuit breaker, electromagnetic coil 26 is actuated to attract armature 32 and pivot actuator arm 35 into engagement with finger 118 to rotate collar 90 against the bias of coil spring 110 from its lock position to its unlock position. The movement of collar 90 to its unlock position allows ball bearings 100 to move radially outward from groove 116 to enable slide rod 74 to retract into barrel 72. Under the action of torsion spring 68, linkage 70 is collapsed and contact bar 44 is raised upward to rapidly disengage contact elements 52 and 54 and interrupt the electrical circuit.

After the circuit breaker is actuated to interrupt the electrical circuit, the switch mechanism is reset by movement of control handle 40 to its off positon (FIG. 3) whereby slide rod 74 is extended relative to barrel 72 and locked in its extended position. Annular groove 116 is moved into alignment with holes 98 to allow ball bearings 100 to move radially inward into the groove and collar 90 returns to its lock position under the action of coil spring 110. Thereafter, control handle 40 is moved to its on position to return contact bar 44 downward against the bias of spring 68 and engage contact elements 52 and 54.

Alternatively, coil spring 110 can be wound in the opposite direction to maintain the linkage normally unlocked or the spring may be eliminated completely to allow the lock or unlock position to be selected as desired. In addition, more than one groove 116 can be provided on slide rod 74 to allow it to be selectively locked in different positions relative to barrel 72. Moreover, both ends of barrel 72 may be opened to increase the length of travel of slide rod 74 relative to the barrel. If desired, mass can be added to or removed from lock collar 90 and finger 118 to dynamically balance the collar and reduce the effects of shock and vibration in the operation of the circuit breaker switch mechanism.

In conclusion, the present invention provides an improved circuit breaker switch mechanism which is less complicated in structure and more positive in action than the prior art devices. The faster contact separation action reduces arcing when the electrical contacts are disengaged. The ball bearings in the locking mechanism serve to substantially reduce the amount of friction encountered in the locking and unlocking operations. Moreover, the equidistant spacing of the ball bearings serves to uniformly distribute the locking and unlocking forces on the barrel and slide rod linkage.

While a specific embodiment of the invention has been shown and described in detail, it will be understood that the invention may be modified without departing from the spirit of the inventive principles as set forth in the appended claims.

I claim:

1. A circuit breaker comprising: an overcurrent sensor for sensing an electrical overload; a stationary contact; a movable contact electrically coupled to said overcurrent sensor and movable between open and closed positions out of and into contact with said stationary contact, respectively; collapsible coupling means coupled to said movable contact and adapted to be tripped by said overcurrent sensor, said movable contact being movable between its closed and open positions in response to tripping of said collapsible coupling means; and actuator means movable in response to an overload condition detected by said overcurrent sensor for tripping said collapsible coupling means; wherein said collapsible coupling means comprises:

a pair of telescoping members relatively slideable one within the other;

locking means movably supported by the outer one of said pair of telescoping members and movable into and out of locking engagement with the inner one of said pair to telescoping members upon movement of said inner member to a predetermined extended position wherein said outer member, wherein, in the locking position, said locking means substantially prevents said telescoping members from moving relative to each other, and, in the unlocking position, said locking means permits relatively slideable movement of said telescoping members;

restraining means supported on said outer telescoping member and movable between a first position in which said restraining means prevents movement of said locking means out of said locking position and a second position in which said restraining permits movement of said locking means out of said locking position toward and into said unlocking position; and bias means biasing said restraining means toward said first position to automatically move said locking means into said locking position upon movement of said inner member to said predetermined extended position within said outer member;

wherein said actuator means is movable in response to an overload condition detected by said overcurrent sensor for engaging said restraining means and moving said restraining means toward and into said second position against the force of said bias means to thereby permit movement of said locking means into said unlocking position and thereby further permit collapsing of said coupling means and movement of said movable contact into its open position.

2. Apparatus according to claim 1, wherein said breaker further comprises handle means coupled to said collapsible coupling means and selectively movable between on and off positions; wherein movement of said handle means into its off position following triggering of said collapsible coupling means by said actuator means moves said coupling means into its extended locked position.

3. Apparatus according to claim 1 or 2, further comprising: bias means coupled to said movable contact for urging said collapsible coupling means into its collapsed position upon triggering said locking means by said actuator means.

4. Apparatus according to claim 3, wherein said outer telescoping member comprises a tubular barrel and said inner telescoping member comprises a slide rod slideably received within said barrel.

5. Apparatus according to claim 4, wherein:

said locking means comprises a plurality of ball bearings located within a set of peripheral holes formed in said tubular barrel and an annular groove formed on said slide rod for alignment with said holes with said slide rod in its predetermined extended position; and said restraining means comprises a collar rotatably disposed on said tubular barrel over said holes to control the positions of said ball bearings therein, said collar being rotatable between a locked position wherein said ball bearings are held in said groove to substantially prevent relative sliding movement of said barrel and slide rod and an unlocked position wherein said ball bearings are able to move out of said groove to permit said rod to slide relative to said barrel.

6. Apparatus according to claim 5, wherein:

said overcurrent sensor comprises an electromagnet for sensing an overload condition in the electrical circuit; and said actuator means comprises a control arm operable by said electromagnet for rotating said collar to its unlocked position when an overload condition is sensed.

7. Apparatus according to claim 6, wherein said collar includes an outwardly extending finger engageable by said control arm upon actuation of said electromagnet for rotating said collar to its unlocked position.

8. Apparatus according to claim 5, wherein:

said tubular barrel includes an annular flange adjacent to which said collar is rotatably disposed, said flange including a gap formed therein; and said collar includes a stop pin received in said gap of said flange to limit the rotation of said collar relative to said barrel.

9. Apparatus according to claim 8, further comprising a coil spring disposed around said tubular barrel with a first end thereof anchored in said annular flange and a second end thereof secured to said stop pin to normally bias said collar into its locked position.

10. Apparatus according to claim 5, wherein said collar includes a plurality of angular spaced notches formed on its inner surface corresponding in number to said ball bearings, said notches being out of alignment with said holes when said collar is in its locked position to substantially prevent outward movement of said ball bearings, and said notches being in alignment with said holes when said collar is in its unlocked position to permit outward movement of said ball bearings.

11. A collapsible coupling means for use in a circuit breaker comprising an overcurrent sensor, a stationary and a movable contact electrically coupled to said overcurrent sensor and movable between open and closed positions out of and into contact with said stationary contact, respectively, means coupling said collapsible coupling means to said movable contact, and means for tripping said coupling means in response to an overload condition detected by said sensor, said movable contact being movable between its closed and open position in response to tripping of said collapsible coupling means, said collapsible coupling means comprising:

a pair of telescoping members relatively slideable one within the other;

locking means movably supported by the outer one of said pair of telescoping members and movable into and out of locking engagement with the inner one of said pair of telescoping members upon movement of said inner member to a predetermined extended position within said outer member, wherein, in the locking position, said locking means substantially prevents said telescoping members from moving relative to each other, and, in the unlocking position, said locking means permits relatively slideable movement of said telescoping members;

restraining means supported on said outer telescoping member and movable between a first position in which said restraining means prevents movement of said locking means out of said locking position and a second position in which said restraining permits movement of said locking means of of said locking position toward and into said unlocking position; and bias means biasing said restraining means toward said first position to automatically move said locking means into said locking position upon movement of said inner member to said predetermined extended position within said outer member;

wherein movement of said restraining means toward and into said second position against the force of said bias means permits movement of said locking means into said unlocking position to thereby further permit collapsing of said coupling means in response to an applied collapsing force.

12. Apparatus according to claim 11, wherein said outer telescoping member comprises a tubular barrel and said inner telescoping member comprises a slide rod slideably received within said barrel.

13. Apparatus according to claim 12, wherein:

said locking means comprises a plurality of ball bearings located within a set of peripheral holes formed in said tubular barrel and an annular groove formed on said slide rod for alignment with said holes with said slide rod in its predetermined extended position; and said restraining means comprises a collar rotatably disposed on said tubular barrel over said holes to control the position of said ball bearings therein, said collar being rotatable between a locked position wherein said ball bearings are held in said groove to substantially prevent relative sliding movment of said barrel and slide rod and an unlocked position wherein said ball bearings are able to move out of said groove to permit said rod to slide relative to said barrel.

14. Apparatus according to claim 13, wherein said collar includes an outwardly extending finger engageable by said triggering means for rotating said collar to its unlocked position.

15. Apparatus according to claim 13 or 14, wherein:

said tubular barrel includes an annular flange adjacent to which said collar is rotatably disposed, said flange including a gap formed therein; and said collar includes a stop pin received in said gap of said flange to limit the rotation of said collar relative to said barrel.

16. Apparatus according to claim 15, further comprising a coil spring disposed around said tubular barrel with a first end thereof anchored in said annular flange and a second end thereof secured to said stop pin to normally bias said collar into its locked position.

17. Apparatus according to claim 13, wherein said collar includes a plurality of angular spaced notches formed on its inner surface corresponding in number to said ball bearings, said notches being out of alignment with said holes when said collar is in its locked position to substantially prevent outward movement of said ball bearings, and said notches being in alignment with said holes when said collar is in its unlocked position to permit outward movement of said ball bearings.

* * * * *